US005979006A

United States Patent [19]

Stokes et al.

[11] Patent Number: 5,979,006

[45] Date of Patent: Nov. 9, 1999

[54] LOTION APPLICATOR AND BODY MASSAGE ASSEMBLY

[76] Inventors: Frances Stokes; Rudell Stokes, both of 7107 Flora Ave., Kansas City, Mo. 64131

[21] Appl. No.: 09/057,855

[22] Filed: Apr. 9, 1998

[51] Int. Cl.[6] ..... A47K 7/02; A61H 7/00

[52] U.S. Cl. ..... 15/222; 401/8; 601/17; 601/132; 601/143; D24/206; D24/211; D24/214; D28/7

[58] Field of Search ..... 15/222; 401/6–8; 601/15, 17, 19, 22, 124, 129, 131, 132, 136–138, 143; D24/200, 206, 211, 214; D28/7

[56] References Cited

U.S. PATENT DOCUMENTS

| | | | |
|---|---|---|---|
| 2,485,899 | 10/1949 | McBreen | 15/222 X |
| 3,124,827 | 3/1964 | Hull | 401/201 |
| 3,674,374 | 7/1972 | Jennings | 401/8 |
| 3,720,205 | 3/1973 | Liebman | 601/143 |
| 3,977,796 | 8/1976 | Gillespie et al. | 401/8 |
| 4,512,054 | 4/1985 | Clark | 15/222 |
| 4,672,707 | 6/1987 | Johnson | 15/222 |
| 4,906,118 | 3/1990 | Crooks | 401/6 |
| 4,915,096 | 4/1990 | Winstone et al. | 601/143 |
| 4,934,011 | 6/1990 | Haug | 15/145 |
| 4,974,279 | 12/1990 | Mathison | 15/160 |
| 5,013,171 | 5/1991 | Almond, II | 401/6 |
| 5,035,523 | 7/1991 | Allinder | 401/6 |
| 5,353,819 | 10/1994 | Kahn et al. | 132/320 |
| 5,386,609 | 2/1995 | Xenos | 15/222 |
| 5,545,456 | 8/1996 | Suida | 428/76 |

*Primary Examiner*—Mark Spisich
*Attorney, Agent, or Firm*—Kenneth L Tolar

[57] ABSTRACT

The present invention relates to a lotion applicator and massaging apparatus including a pair of opposing substantially U-shaped handles with an attachment plate attached to each of their respective terminal ends. The two opposing attachment plates each have a plurality of cords extending from an opposing side with a snap style connector at their distal ends. A select one of a plurality of accessory pads may be attached to the U-shaped handles depending upon the application. Each applicator pad is substantially rectangular having four peripheral edges and a panel at two opposing edges thereof. Extending from each panel are a plurality of cords with a snap style connector at their distal ends for selectively engaging the snap style connectors on the U-shaped handles. Accordingly, a loofah sponge pad, a dry weave pad or a roller ball massage pad may be selectively attached to the U-shaped handles using the snap style connectors. A heating device is also provided allowing a user to selectively preheat any one of the accessory pads prior to use.

7 Claims, 2 Drawing Sheets

LOTION APPLICATOR AND BODY MASSAGE ASSEMBLY

BACKGROUND OF THE INVENTION

The present invention relates to a lotion applicator and body massage assembly, and more particularly, to an applicator having a pair of opposed handle members removably attached to opposing sides of any one of a plurality of accessory pads allowing the device to function as a wash cloth, a lotion applicator or as a massaging device.

DESCRIPTION OF THE PRIOR ART

Certain areas of a person's back are inaccessible by hand. Accordingly, it is practically impossible for a user to wash, scrub, massage or apply lotions to these areas without the assistance of another person. Numerous hand held lotion applicators, back scrubbers and massaging devices have been developed in an attempt to solve this problem. For example, U.S. Pat. No. 4,196,490 issued to Jonzon relates to a washing sponge having a coarse material on one side and a soft material on the opposing side. The sponge has a pair of opposing slots through which extend a pair of straps each having a D-shaped handle at a distal end.

U.S. Pat. No. 3,977,796 issued to Gillespie discloses a body scrubber comprising a strip of nylon net superimposed on a strip of terry cloth. A plurality of pockets are formed between the strips for receiving a bar of soap. Each end of the strip has a circular ring that functions as a handle.

U.S. Pat. No. 3,959,841 issued to Home relates to a lotion applicator comprising an elongated strip of fabric having a centrally located pocket for receiving a disposable pad such as paper. Integral loop type handles are formed at each end of the fabric by transversely stitching the fabric strip.

U.S. Pat. No. 4,974,279 issued to Mathison relates to a back brush having a flexible, helically wound wire core containing a series of three separate randomly arranged sets of bristles. Each end of the wire core has a hand loop which may be grasped by a user.

U.S. Pat. No. 4,672,707 issued to Johnson relates to a washing device comprising a pair of handle members with a sponge member disposed therebetween. The device includes a flexible, elongated encasement member that receives the sponge member.

U.S. Pat. No. 4,512,054 issued to Clark relates to a terrycloth back scrubber including a wider central scrubber section extending from which are a plurality of alternating pleats. Elongated handle members integrally extend from opposing ends of the scrubber section.

U.S. Pat. No. 3,674,374 issued to Jennings relates to a back scrubber comprising a mesh type nylon scrubbing surface having soap retaining pockets and flexible loop shaped handles at each end.

U.S. Pat. No. 3,124,827 issued to Hull relates to a washcloth with a soap receiving pocket having a drawstring at two opposing open ends.

U.S. Pat. No. 5,545,456 issued to Sweda discloses an elongated washcloth having a plurality of integral pockets each having an open end enclosable with a securing flap for receiving soap or a plurality massaging balls.

Although various back scrubbers and lotion applicators exist in the prior art, these devices have several disadvantages. None of these devices relate to a pair of opposing handle members to which a plurality of accessory pads, including a massaging pad may be interchangeably attached. Although the device in Sweda relates to a washcloth within which a massaging device may be received, the massaging unit relates to a plurality of separate balls secured within a pocket. Placing the separate balls in a pocket is objectionable since such cloth type pockets are easily opened or torn. The separate balls may be easily lost or misplaced and cannot be simultaneously and quickly attached to the handles as with the present invention. Also, because the balls are within a cloth pocket, they do not directly engage a user's skin thereby providing an inferior massage. The present invention provides a massaging pad having a plurality of balls integral therewith which may be quickly and conveniently attached to a pair of handles.

Likewise, none of the above described devices relate to a pair of handles having a universal attachment means for interchangeably receiving a plurality of pads. Accordingly, an unlimited number of pads each having a unique surface or function may be manufactured for use with the opposing handle members according to the present invention.

Finally, the devices described above having a pair of opposing handles are made entirely from a flexible, fabric material and therefore must be grasped at each end thereby occupying both hands of a user. The present invention relates to a slightly rigid device having two opposed handle members either of which may be grasped with one hand and reciprocated and is therefore more convenient to use.

SUMMARY OF THE INVENTION

The present invention relates to a lotion applicator and body massage assembly comprising a pair of opposing U-shaped handles each covered with a foam sleeve. Attached to the terminal ends of each U-shaped handle is an attachment plate having a plurality of cords extending from an opposing side thereof. A distal end of each cord has a snap connector for matably engaging a corresponding snap connector on an accompanying assembly pad.

Each accessory pad is substantially rectangular having four peripheral edges with a panel on two opposing edges thereof. Extending from each panel is a snap type connector for engaging the snap connectors on the U-shaped handles. Accordingly, any one of a plurality of accessory pads may be interchangeably attached to the handle members.

The accessory pads according to the present invention include a dry weave pad for applying lotions, creams and similar materials, a loofah sponge pad which may be used when bathing and a roller ball massage pad for massaging the torso or limbs. Each of the pads may be preheated in an accompanying heater device prior to use. It is therefore an object of the present invention to provide a lotion applicator assembly having a plurality of interchangeable applicator pads.

It is yet another object of the present invention to provide a lotion applicator assembly in which any one of a plurality of interchangeable accessory pads may be selectively preheated.

It is yet another object of the present invention to provide a lotion applicator assembly in which the accessory pads may be quickly and easily attached.

It is yet another object of the present invention to provide a lotion applicator assembly that may be interchangeably used as a massaging or washing device. Other objects, features and advantages of the present invention will become readily apparent from the following detailed description of the preferred embodiment when considered with attached drawings and the appended claims.

DESCRIPTION OF THE PREFERRED EMBODIMENT

Figure 1:
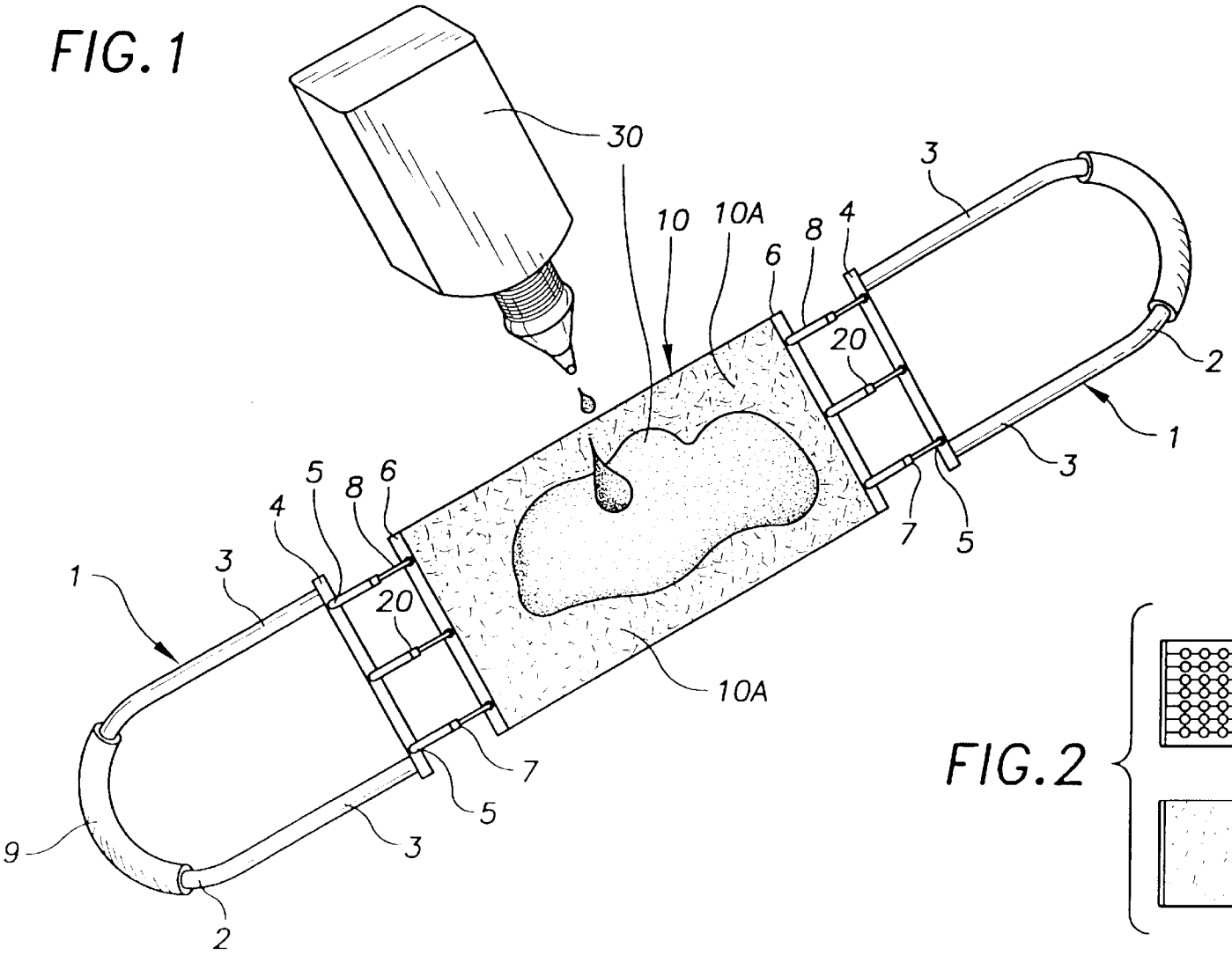
FIG. 1 depicts the inventive device.

The present invention relates to a new and improved lotion applicator assembly which may be interchangeably used as a bathing or massaging device. The device includes a pair of substantially U-shaped handles 1 each including an arcuate portion 2, which may be grasped by a user, extending from which are a pair of terminal ends 3. Attached to each pair of terminal ends 3 is an attachment plate 4 extending from an opposing side of which are a plurality of cords 5 preferably made from nylon or a similar material. A distal end of each cord 5 has a snap connector 7 thereon such as what is commonly referred to as a gimbal connector. However, as will be readily apparent to those skilled in the art, many different snaps or attachment means may be used without departing from the spirit of the present invention. Disposed around the arcuate portion of each handle member is a foam sleeve 9 providing a soft, comfortable surface to be grasped by a user. Preferably, each sleeve is covered with a protective, flexible plastic layer to protect it from wear and tear.

Each accessory pad is substantially rectangular having two opposed longitudinal and two opposed lateral edges and an upper and a lower surface. On the upper surface is a lotion applicator surface, a washing surface or a massaging device as described below. Integral with each opposing lateral side is a panel 6 similar to that of the attachment plate 4 on the U-shaped handle. Extending from each panel are a plurality of cords 8 each having a snap connector 20 at a distal end for selectively engaging the snap connectors 7 on the attachment plate cords. Accordingly, the U-shaped handles may be quickly and easily attached to opposing sides of an accessory pad by coupling each snap type connector extending from the panel to a corresponding snap type connector on a U-shaped handle.

Three different accessory pads according to the present invention are provided. The first accessory pad relates to a lotion applicator 10 having fabric 10A on a side thereof for applying lotions 30 and similar substances. The fabric surface 10A is preferably constructed with a dry weave fabric or a similar material that is washable allowing a user to selectively apply lotions, gels, creams or oils.

A second accessory pad relates to a washing device 11 having a loofah sponge material 11A on a side thereof. The washing device 11 is particularly suitable for assisting a bather in scrubbing or washing otherwise inaccessible areas such as the back or neck.

Figure 2:
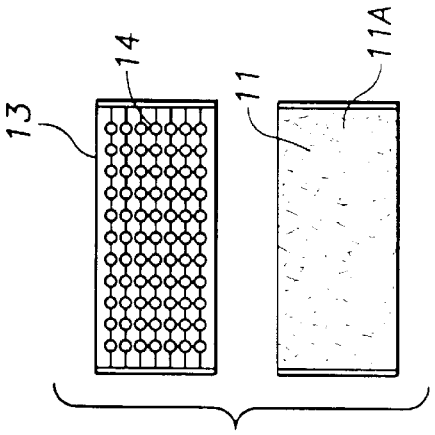
FIG. 2 depicts two of the interchangeable accessory pads according to the present invention.
Figure 3:
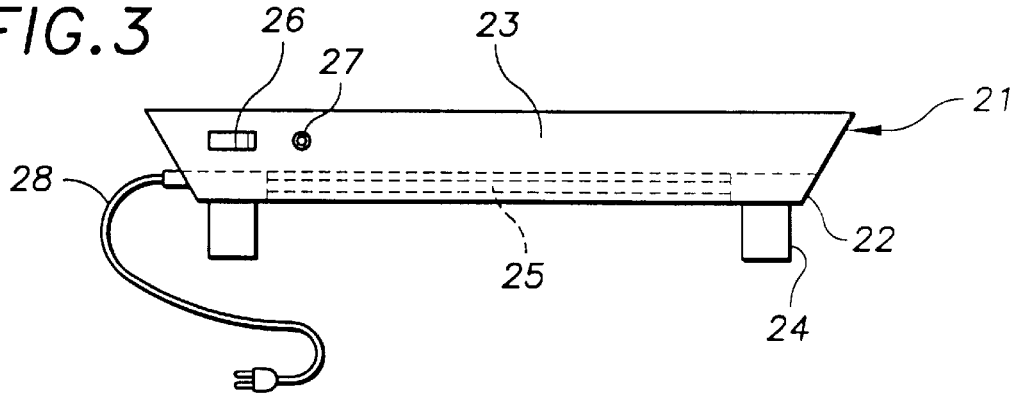
FIG. 3 depicts the heating device according to the present invention.
Figure 4:
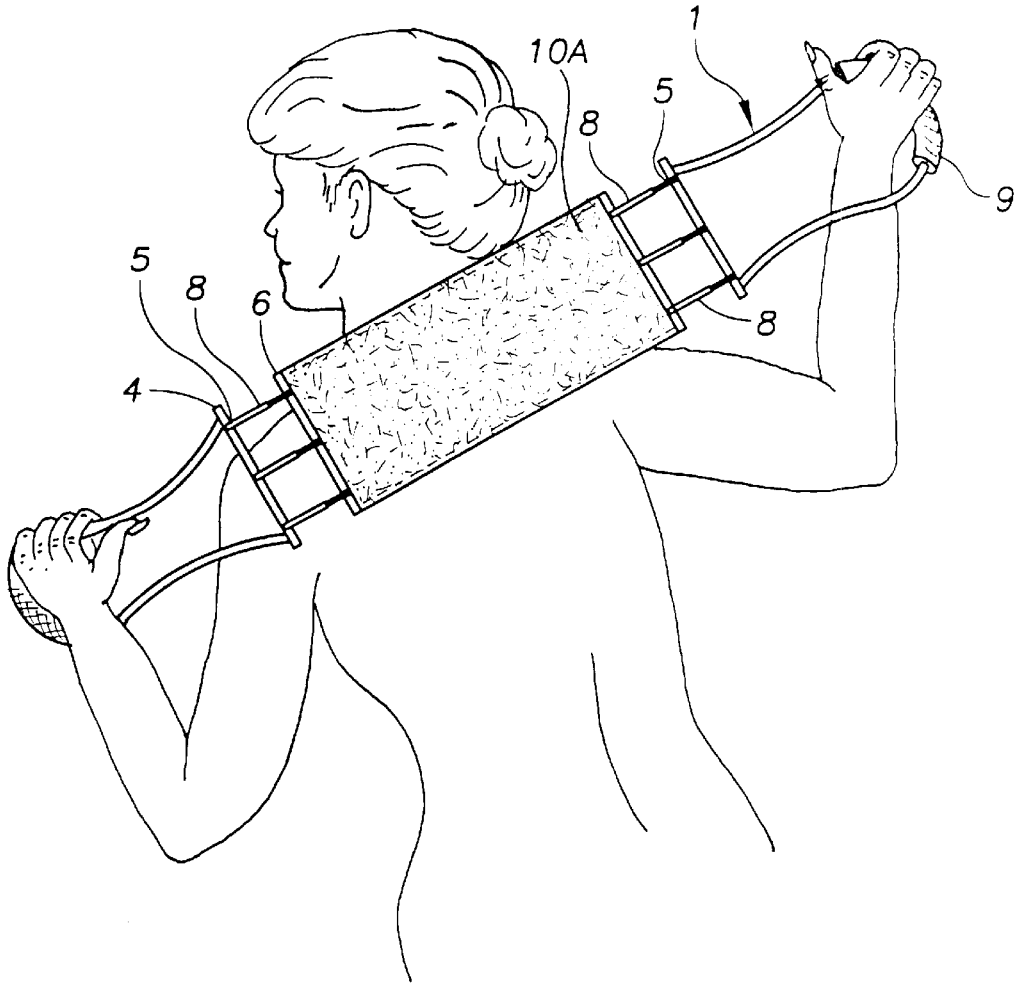
FIG. 4 depicts the inventive device being used by a bather with the third applicator pad attached thereto.

A third accessory pad is depicted in FIG. 2 and relates to a massaging pad 13. The pad includes a plurality of miniature, rigid balls 14, preferably made from wood or a similar rigid material, on a side thereof. The pad 13 may then be reciprocated across a user's skin to provide a quick, convenient therapeutic massage.

Each of the above described applicator pads may be selectively preheated using an accompanying heating mechanism 21. The heating mechanism is similar to a standard food warming tray and comprises a housing 22 having a shallow pan component 23 integral therewith dimensioned to receive any of the above described applicator pads. The housing preferably has a plurality of support legs 24 extending therefrom to support the pan component 23 a predetermined distance above a support surface. Received within the housing 22 are a plurality of heating elements 25 which are selectively activated with a switch means 26. The heating elements 25 are disposed below the bottom surface of the pan component. Preferably, the heating elements are of the Nichrome wire type enclosed in an insulated covering. A light means 27 on the exterior surface of the housing indicates when the heating elements have reached a predetermined temperature. The heating mechanism is powered with a standard electrical cord 28. Accordingly, before attaching a select accessory pad to the U-shaped handles, a user may place the pad in the specifically configured heating assembly to heat the pad to a desired temperature.

As will be readily apparent to those skilled in the art, the above described device is not limited to the exact details enumerated above. For example, any type of conventional attachment means may be used to attach the pads to the U-shaped handles. In addition, the size, shape and materials of construction of the various components may be varied without departing from the spirit of the present invention.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A lotion applicator assembly comprising:

a pair of U-shaped handles, each having an arcuate portion and a pair of terminal ends extending therefrom;

a pair of attachment plates, each attached to a pair of terminal ends of the U-shaped handles;

a plurality of flexible cords extending from an opposing side of each attachment plate, each having a snap type connector at a distal end thereof;

an accessory pad having a planar upper surface and a pair of opposing peripheral edges;

a plurality of cords extending from the two opposing edges, each cord having a snap type connector at a distal end for selectively engaging a snap type connector on said attachment plate cords whereby said accessory pad may be detachably disposed between said handles.

2. A lotion applicator assembly according to claim 1 wherein said accessory pad has a loofah sponge material on the upper surface thereof.

3. A lotion applicator assembly according to claim 1 wherein said pad has a dry weave fabric on the upper surface thereof.

4. A lotion applicator assembly according to claim 1 wherein said pad has a plurality of integral wooden balls on the upper surface thereof for providing a massage.

5. A lotion applicator assembly according to claim 1 further comprising a foam sleeve surrounding the arcuate portion of each U-shaped handle for providing a comfortable surface to be grasped by a user.

6. A lotion applicator assembly according to claim 1 further comprising a heating means for selectively preheating an accessory pad to a desired temperature prior to use.

7. A lotion applicator assembly according to claim 6 wherein said heating means comprises:

a hollow housing having an exterior surface and a recessed pan member thereon, said pan member dimensioned to receive an accessory pad;

a plurality of heating elements received with said housing and proximal said recessed pan member;

a switch means on the exterior surface of said housing in communication with said heating elements for selectively activating said heating elements;

a light means on the exterior surface of said housing in communication with said heating elements for indicating when said heating elements have reached a predetermined temperature whereby a select one of the accessory pads may be preheated prior to being attached to said U-shaped handles.

* * * * *